United States Patent [19]

Shimai

[11] 3,971,520

[45] July 27, 1976

[54] APPARATUS FOR DOFFING AND INSERTING EMPTY CORES ON AN AUTOMATIC WINDER

[75] Inventor: Junichiro Shimai, Kyoto, Japan

[73] Assignee: Murata Kikai Kabushiki Kaisha, Kyoto, Japan

[22] Filed: Aug. 8, 1974

[21] Appl. No.: 496,088

[30] Foreign Application Priority Data

Aug. 14, 1973 Japan ..... 48-91394

[52] U.S. Cl. ..... 242/35.5 A; 242/35.6 R

[51] Int. Cl.[2] ..... B65H 54/20; B65H 54/24; B65H 67/04

[58] Field of Search ..... 242/35.5 A, 35.5 R, 242/35.6 R, 18 R, 18 DD

[56] References Cited

UNITED STATES PATENTS

| | | | |
|---|---|---|---|
| 1,700,425 | 1/1929 | Abbott et al. | 242/35.6 R |
| 3,092,340 | 6/1963 | Furst | 242/35.5 R |
| 3,184,174 | 5/1965 | Furst | 242/35.5 R |
| 3,476,328 | 11/1969 | Shimai et al. | 242/35.5 R |
| 3,791,126 | 2/1974 | Kose et al. | 242/35.5 A UX |
| 3,801,030 | 4/1974 | Kobatake et al. | 242/35.5 A X |
| 3,820,730 | 6/1974 | Endo et al. | 242/35.5 A X |

FOREIGN PATENTS OR APPLICATIONS

| | | | |
|---|---|---|---|
| 9,703 | 4/1968 | Japan | 242/35.5 A |
| 1,103,267 | 2/1968 | United Kingdom | 242/35.5 A |

*Primary Examiner*—Stanley N. Gilreath
*Attorney, Agent, or Firm*—Burgess Ryan and Wayne

[57] ABSTRACT

An apparatus is disclosed for doffing and inserting empty cores on an automatic winder having core holders each clamping and freeing cores by assuming two prescribed positions, said apparatus being comprised of a position holding mechanism for holding cradle parts of winding units, a forwarding mechanism for arranging a package in a direction adapted for taking it off, a package take-off mechanism for taking off the package from the core holder, a package receiving mechanism for receiving the package so taken off, a yarn severing and holding mechanism for severing a yarn on a path from a bobbin of the winding unit to the package and carrying the yarn end to the core holder part, a core inserting mechanism for inserting an empty core over the core holder and returning the core holder to the winding up position and a core supply mechanism for supplying empty cores to the core inserting mechanism, so that successful doffing can be achieved regardless of the size and type of yarn packages, e.g. cheese-type packages or cone-type packages.

9 Claims, 15 Drawing Figures

APPARATUS FOR DOFFING AND INSERTING EMPTY CORES ON AN AUTOMATIC WINDER

The conventional apparatus for doffing and inserting empty cores on an automatic winder is designed for use with packages of the so-called cheese wind type. Especially, in the case of the doffing apparatuses, because packages are of the cheese wind type, there is the advantage that the packages can be easily transported after doffing by means of the turning movement of the doffed packages. A further advantage is that the cradle arms hold packages by clamping the same by spring force on both ends thereof and the packages can be very easily removed by opening the cradle arms sideways. However, when the doffing operation must be carried out on an automatic winder used for packages of the so-called cone type, several difficulties arise when compared to doffing the cheese wind type packages. That is, because the packages are of conical shape, it is difficult to make use of the turning movement of the packages in their transportation. In addition, as the cradle arm only holds one side, the core holder must be of a type which holds the core from inside by opening outward, and considerable difficulty is experienced when taking off a full package from this type of core holder.

It is the object of the present invention to provide an apparatus for doffing and inserting empty cores on an automatic winder usable for packages of the cone wind type without the difficulties encountered with the conventional systems.

That is, the apparatus of the present invention is of the type which, as disclosed in Japanese Utility Model publication No. 41-18125, has core holders of the one side holding type which are capable of assuming two positions by turning, one position being for holding and the other for freeing the packages. Regardless of the size and type of packages, e.g. packages of the cheese wind type and of the cone wind type, a series of operations such as doffing of the packages, insertion of the empty cores, bunch winding and restarting of the winding operation are carried out in sequence automatically.

The apparatus of the present invention is comprised of a position holding mechanism for holding the cradle parts of winding units, a forwarding mechanism for arranging a package in a direction adapted for taking it off, a package take-off mechanism for taking off the package from the core holder, a package receiving mechanism for receiving the package so taken off, a yarn severing and holding mechanism for severing a yarn on a path from a bobbin of the winding unit to the package and carrying the yarn end to the core holder part, a core inserting mechanism for inserting an empty core over the core holder and returning the core holder to the winding up position and a core supply mechanism for supplying empty cores to the core inserting mechanism.

Further features and advantages of the present invention will be made clearer from the ensuing description, reference being made to the accompanying drawings, in which.

Figure 1:
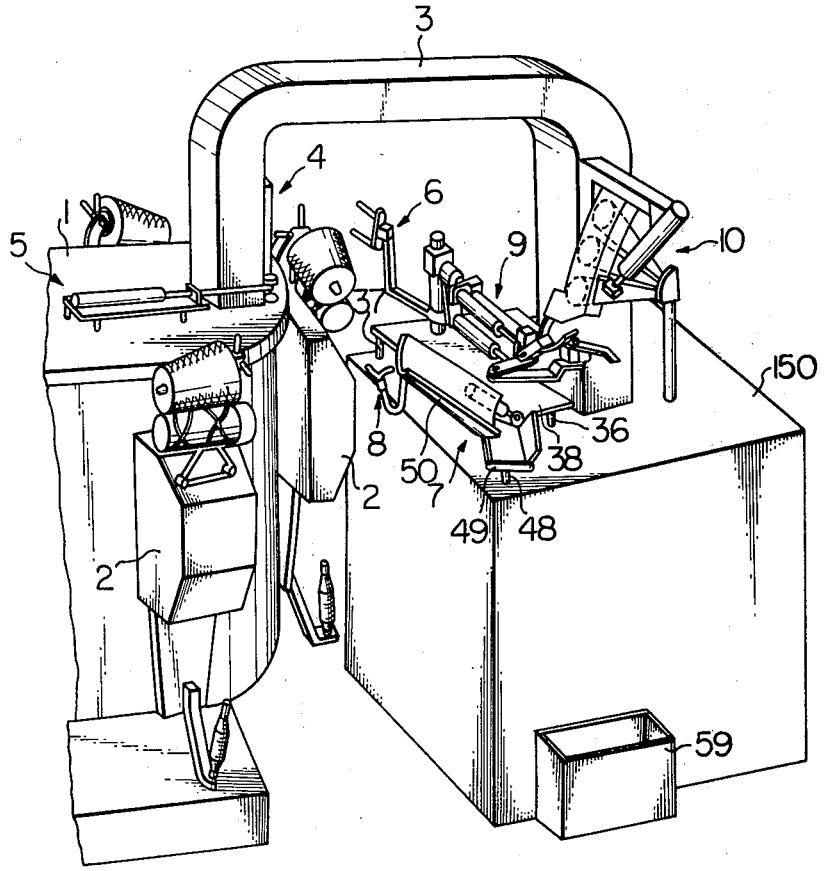
FIG. 1 is an entire perspective plan view of the apparatus of the present invention.

In the arrangement shown in FIG. 1, the main body 1 of the automatic winder is of oblong construction and is provided with a plurality of winding units 2 which travel in a circulating manner along a path defined by the main body 1. The automatic winder is also provided at one terminal of the unit circulating path with an air tube 3 for cleaning of the main body side, which tube 3 is connected to a blower box 150 equipped internally with an air supply source such as a fan. In combination with the above-described arrangement, the following several mechanisms are provided for the present invention.

A position holding mechanism 4 is provided on one side of the main body side end of the air tube 3, and near the position holding mechanism 4 a forwarding mechanism 5 is mounted atop the main body 1. At the other side end of the air tube 3, i.e. the end of the air tube 3 on the side of the blower box 150, a package take-off mechanism 6, a package receiver mechanism 7, a yarn severing and holding mechanism 8, a core inserting mechanism 9 and a core supplying mechanism 10 are mounted atop the blower box 150.

Figure 2:
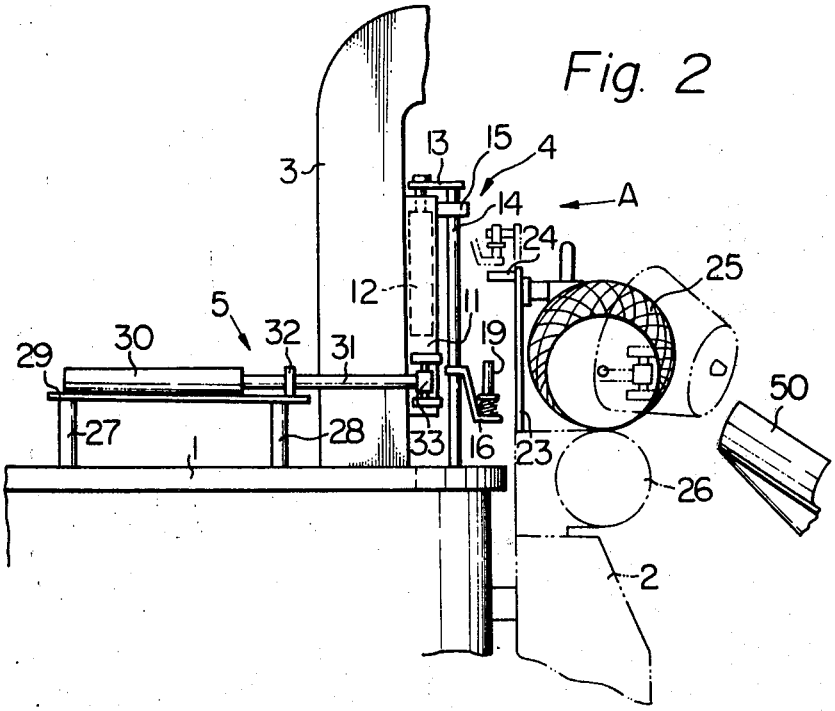
FIG. 2 is a front plan view of the position holding and forwarding mechanisms.
Figure 3:
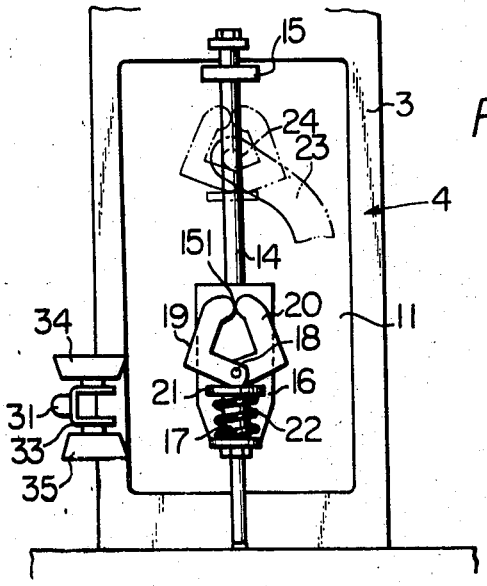
FIG. 3 is a view seen in the direction of the arrow A in FIG. 2.

The detail construction of the position holding mechanism 4 is shown in FIGS. 2 and 3, in which the entire construction of this mechanism 4 is mounted on a base block 11 of a rectangular top plan view profile. An air cylinder 12 encased within the base block 11 is connected to a sliding rod 14 via an intermediate connecting rod 13 linked atop the piston rod and this sliding rod 14 reciprocates vertically, being guided by a guide piece 15 fixed to the base block 11, when the same is actuated by the air cylinder 12. However, in the standby disposition, the bottom end of this sliding rod 14 is positioned near the uppersurface of the main body 1 of the winder.

A holder piece 16 affixed to the stem of the sliding rod 14 securedly holds a holder rod 17. A pair of clamper pawls 19 and 20 are pivoted at a pin 18 disposed atop holder rod 17. The free ends of the clamper pawls 19 and 20 are urged into pressure contact with each other when the pawls 19 and 20 are pushed upwards by a pressor piece 21, which is inserted movably mounted over the holder rod 17, and being urged by an associated spring 22. The free ends 151 of the clamper pawls 19 and 20 are round in shape.

Upon lifting of the sliding rod 14 by the operation of the air cylinder 12, a pin 24 of an increase lever 23 integral with the cradle arm of the corresponding winding unit 2 forces its way into the contact between the free ends of the clamper pawls 19 and 20, thereby overcoming the repulsion force of the spring 22. The pin 24 is brought upwards as shown with chain-and-dot lines in FIG. 3 and full package 25 held by the cradle arm is taken up from a take-up drum 26 to a selected position. The clamper pawls 19 and 20 are kept in this lifted disposition during the subsequent doffing operations while holding the pin 24 in the above-described position.

As shown in FIGS. 2 and 3, the forwarding mechanism 5 is placed on the winder main body 1 and is carried by supporter legs 27 and 28, which carry a base 29 securedly holding an air cylinder 30. A piston rod 31 of this air cylinder 30 is slidable axially, being guided by a guide stand 32 fixed onto the base 29. A channel-shaped frame 33 is fixed to the front end of this piston rod 31 in order to rotatably hold a pair of separate cone rollers 34 and 35. The conical shape of these rollers 34 and 35 is selected in consideration of the surface curvature of the full package 25 so that the same can press the package surface without causing any damage to the package quality. That is, when the full package 25 is lifted and registered at the prescribed position by the operation of the aforementioned position holding mechanism 4, the cone rollers 34 and 35 are brought to the position shown with chain-and-dot lines in FIG. 2 by the forward sliding of the piston rod 31 in order to make the full packages 25 assume the axial direction shown with chain-and-dot line in the illustration. During this process, the cone rollers 34 and 35 keep rolling pressure surface contact with the full package 25 so as to cause no damage to the package quality. In the present invention, the cores of the packages are of known construction and the above-described rotation relieves the core of the clamp exerted thereon.

Figure 4:
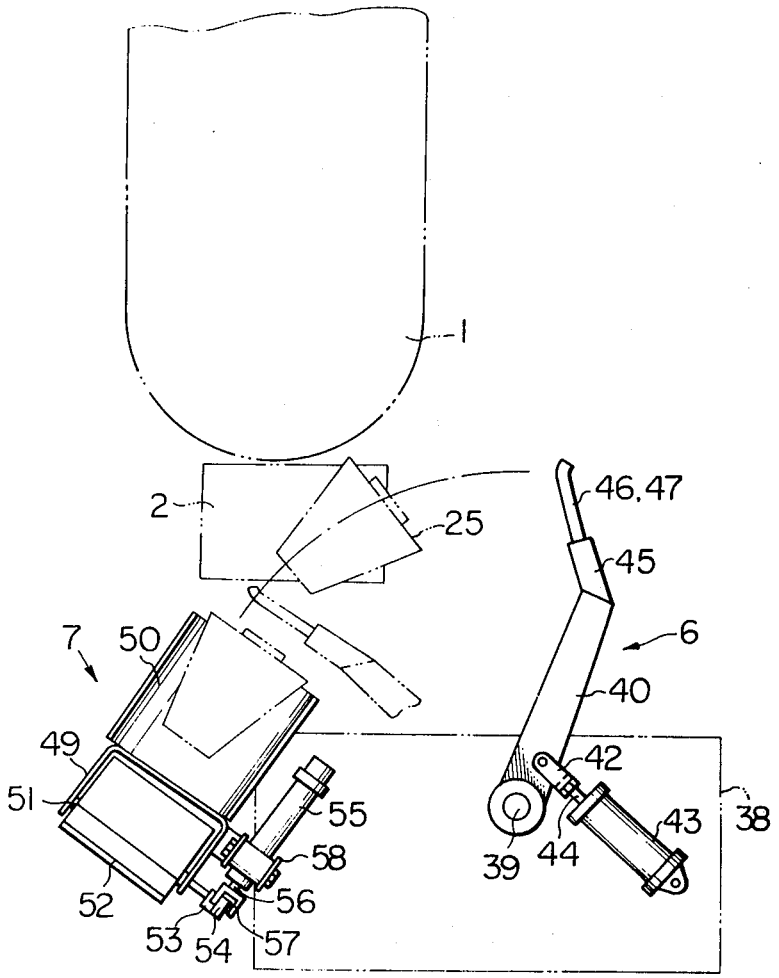
FIG. 4 is a top plan view of the package take-off and receiving mechanisms.
Figure 11:
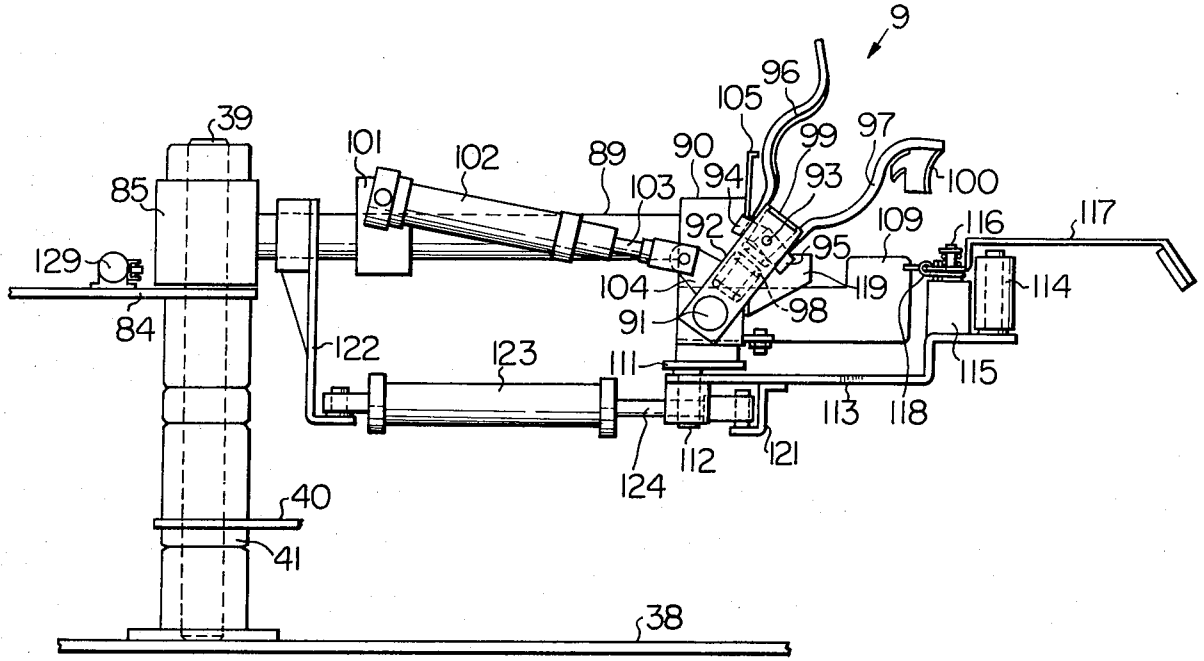
FIG. 11 is a front plan view of the core inserting mechanism.

As shown in FIG. 4, the package take-off mechanism 6 includes a pivot shaft 39 mounted on a base plate 38, which is supported on the blower box 150 in FIG. 1 via supporting legs 36. A lever 40 is swingably mounted on the pivot shaft 39. A bracket 42 is disposed at the root portion of this swingable lever 40, the lever 40 being carried on a spacer 41 as shown in FIG. 11. This bracket 42 is connected to a piston rod 44 of an air cylinder 43 in such a manner that the swinging of the lever 40 is actuated by the operation of the air cylinder 43. A pair of forks 46 and 47 are secured to a block 45, which is affixed to the front end of the swingable lever 40, so that the same pushes the full package 25 off from the core holder onto a receiver plate 50 of the package receiver mechanism 7.

As shown in FIG. 1 the package receiver mechanism 7 is carried by a framework 49 secured on the blower box 150 via two sets of supporting legs 48, to which the receiver plate 50 is affixed. This receiver plate 50 has a semitubular chute like construction in order to receive the full package 25.

In the arrangement shown in FIG. 4, an L-shaped stopper plate 52 is integrally fixed to a shaft 51 which connects both sides of the framework 49 in order to provisionally stop the full package 25, sliding down along the receiver plate 50, and a boss 53 is fixed to one end of the shaft 51. The upper elongated end 54 of the boss 53 is linked to a piston rod 56 of an air cylinder 55 via a channel-shaped member 57, the air cylinder 55 being carried by the framework 49 via a bracket 58.

When the piston rod 56 is pushed out of the air cylinder 55, the shaft 51 turns together with the stopper plate 52 and, thereby, the provisionally stopped full package 25 is made to fall down into a reservoir box 59, shown in FIG. 1 in the case of the present embodiment. It is also possible to make the full package 25 fall down onto an appropriate belt conveyer located at the side of the blower box 150 in FIG. 1.

Figure 8A:
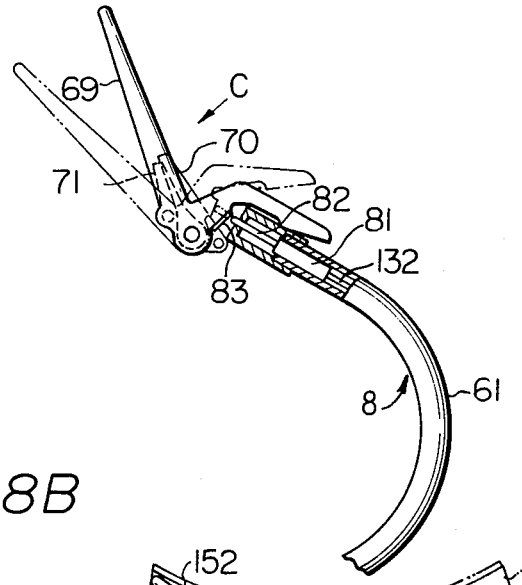
FIGS. 8A and 8B are front plan views of the yarn severing and holding mechanism.
Figure 8B:
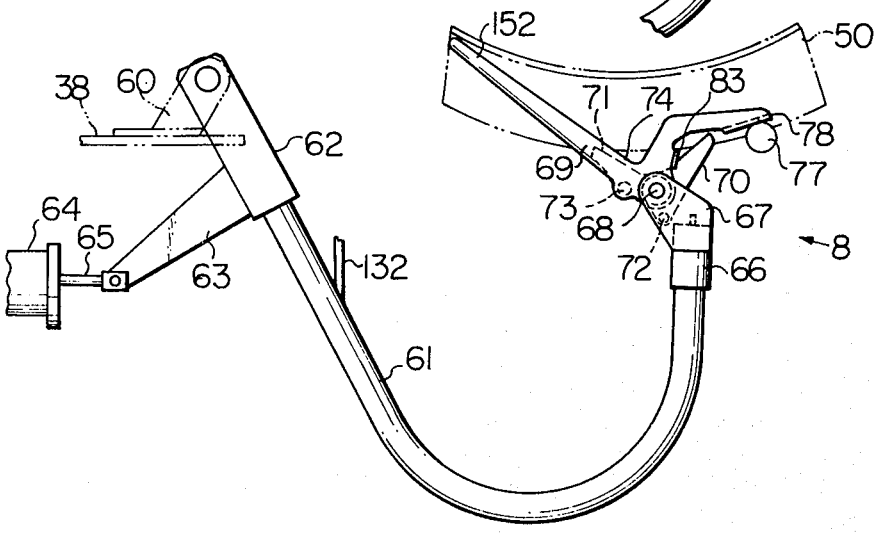
Figure 10:
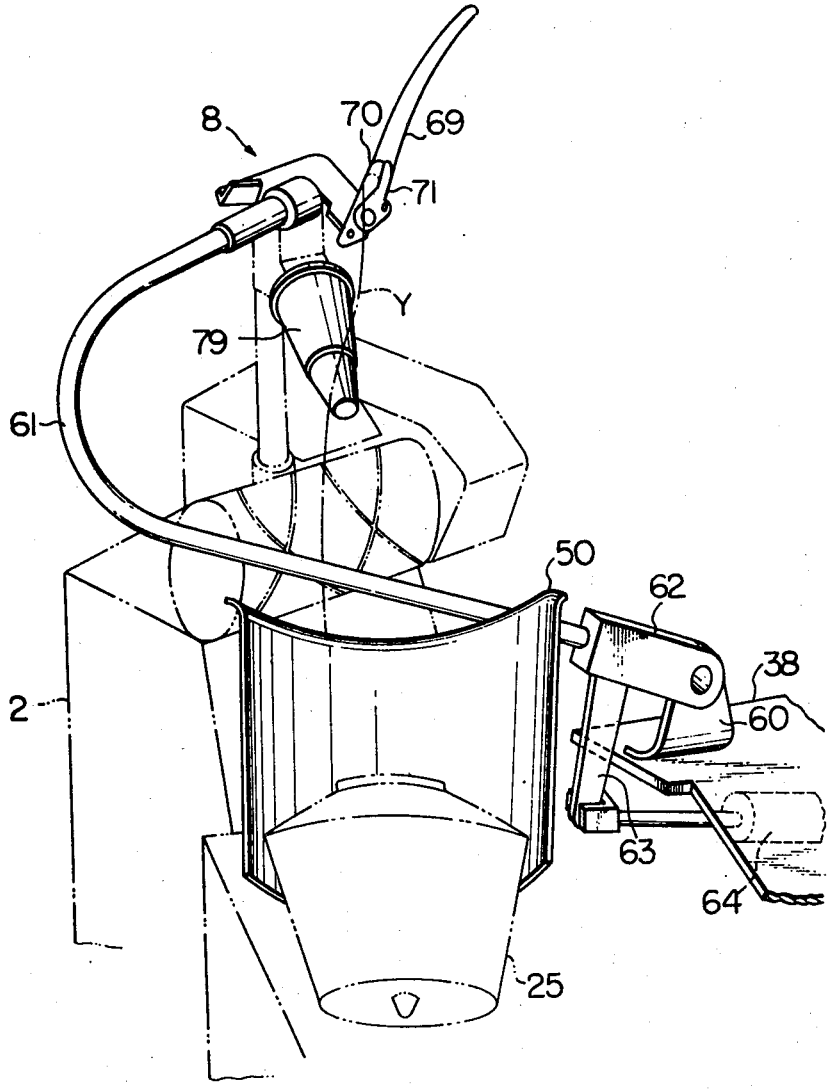
FIG. 10 is a perspective plan view of the yarn severing and holding mechanism in the operating condition.

The yarn severing and holding mechanism 8 is shown in FIGS. 5, 8A and 8B, 9 and 10. Particularly as shown in FIGS. 8A, 8B and 10, a curved tube 61 is turnably carried by a bracket 60 affixed on the base plate 38 and an elongated leg 63 secured to the root 62 of this curved tube 61 is linked to a piston rod 65 of an air cylinder 64. By operation of the air cylinder 64 the curved tube 61 is brought up to the position shown in FIG. 9, the rear end of the air cylinder 64 being pivoted to a bracket (not shown) fixed on the base plate 38.

As shown in FIGS. 8A and B a yarn guide plate 69 of an approximately L-shaped front plan profile, a fixed blade 70 and a movable blade 71 are mounted on a supporting shaft 68 affixed to a piece 67 which is secured to the front end 66 of the curved tube 61. The fixed blade 70 is inserted at its root portion over a pin 72 projecting from the piece 67, that is the fixed blade 70 is integral with the piece 67. On the other hand, the yarn guide plate 69 and the movable blade 71 are connected in one body to each other via a pin 73 and both open and close about the supporting shaft 68 in a manner to nip the fixed blade 70.

The parts of the blades 70 and 71 which contact each other are made very sharp in order to function as a cutter element while no edge is formed on the part of the fixed blade 70 which contacts the yarn guide plate 69. In addition, the edge 74 of the yarn guide plate 69 is round in shape. Therefore, when the yarn is caught by the holding device and the severing mechanism is closed, the part of the yarn on the side of the movable blade 71 is severed while the part of the yarn on the side of the yarn guide plate 69 is held in between the yarn guide plate 69 and the fixed blade 70 without being severed. In the arrangement shown in FIG. 9, a coil spring 75, for closing the yarn severing mechanism, is hooked on one end to the piece 67 and on the other end thereof to the yarn guide plate 69 and the movable blade 71. Under normal conditions, this coil spring 75 urges the yarn guide plate 69 and the movable blade 71 in the clockwise direction about the supporting shaft 68 in FIG. 8B. The reference numeral 76 indicates a spring for urging the severing assembly.

In the stand-by disposition, the yarn severing and holding mechanism 8 of the present embodiment assumes the lower position shown in FIG. 8B, wherein the yarn guide plate 69 annexed to the front end of the curved tube is located just below the upper surface of the receiver plate 50 and the severing assembly is kept open by engagement of the bent end 78 of the yarn guide plate 69 with the bent end 77 of a stop arm which extends through the underside space of the receiver plate 50 from the base plate 38.

Figure 5:
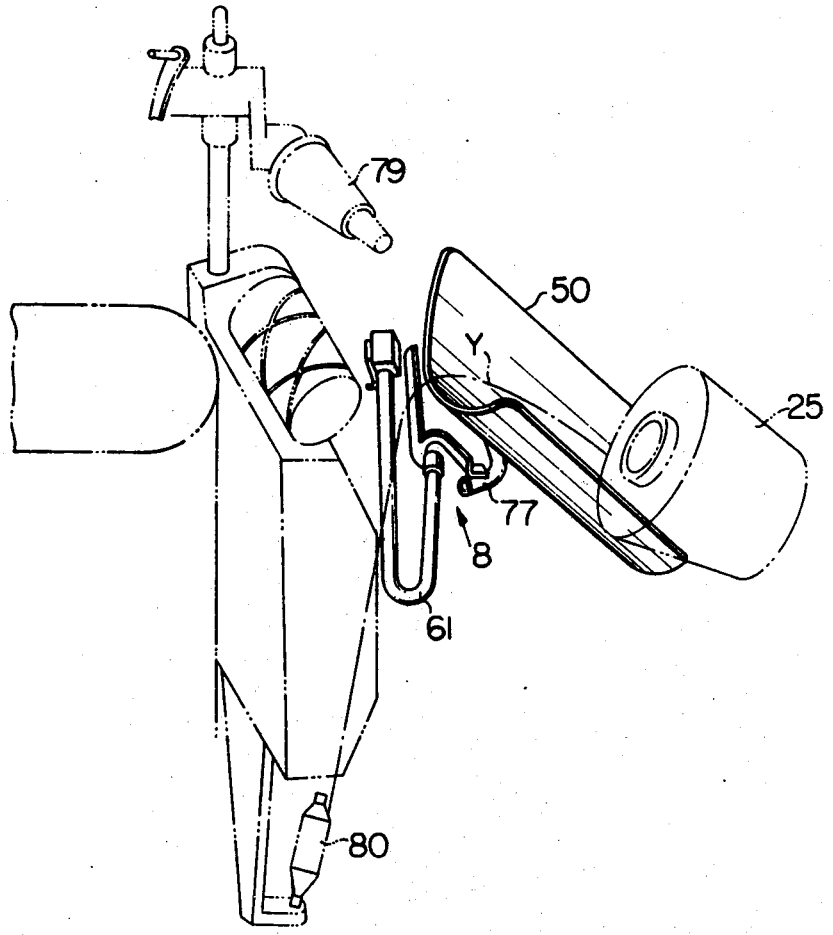
FIG. 5 is a perspective plan view for showing the disposition of the package passed to the receiving mechanism.

In this dispostion of the yarn severing and holding mechanism 8 of the present embodiment, the yarn Y between a bobbin 80 and the package 25 assumes the path shown in FIG. 5 when the package 25 taken off from a core holder 79 is passed onto the receiver plate 50. At this moment, the air cylinder 64 operates so as to swing the curved tube 61 upwardly and the bent end 78 of the yarn guide plate 69 is disengaged from the bent end 77 just at the start of this upward swinging of the curved tube 61 and, thereby, the severing assembly is closed. At this state of the procedure, the yarn Y is picked up by the elongated end 152 (see FIG. 8B) of the yarn guide plate 69 and goes down along the fringe 74, the package side yarn is severed by the closing of the yarn severing assembly, the bobbin side yarn is clamped and brought upwards and the yarn Y comes into contact with the core holder 79 when the curved tube 61 assumes its uppermost position shown in FIG. 10.

Again in FIG. 8A, a small air cylinder 81 is disposed at the front end portion of the curved tube 61 and its piston rod 82 engages a small bent portion 83 of the yarn guide plate 69 at its forward stroke. The yarn guide plate 69 is turned over a small ambit in order to open the severing assembly. This turning of the yarn guide plate 69 is caused by the release of the bobbin side yarn end when an empty core is inserted over the core holder 79 in FIG. 10 by a later described mechanism.

Figure 12:
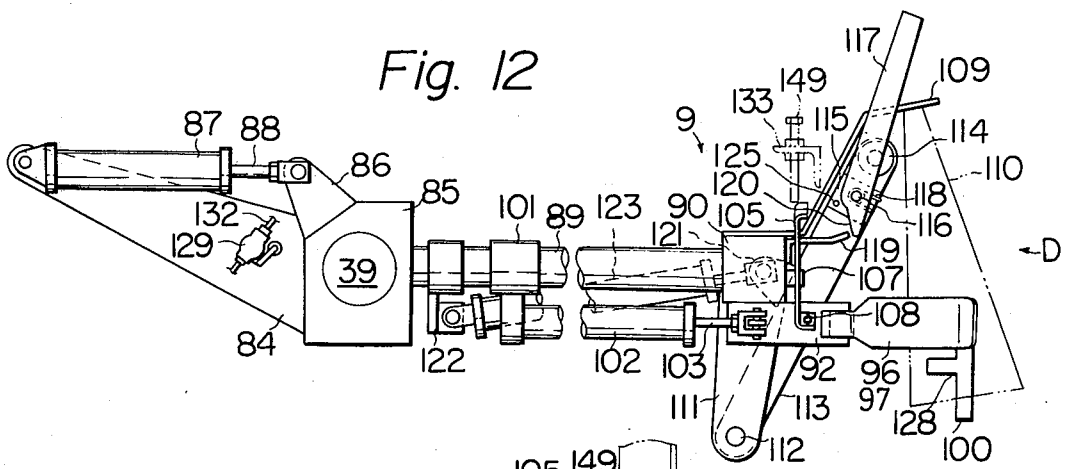
FIG. 12 is a top plan view of same.

The core inserting mechanism 9 of the present embodiment is shown in FIGS. 11, 12, 13 and 14. In FIG. 11, a boss 85 is turnably inserted over a supporting bracket 84 which is securedly mounted on the pivot shaft 39 which in turn stands on the base plate 38. An air cylinder 87 disposed at the rear end thereof to the supporting bracket 84 has a piston rod 88 which is linked to an arm 86 projecting integrally with the boss 85 as shown in FIG. 12. Being driven by the air cylinder 87, the boss 85 and the later described mechanism carried by this boss 85 turn about the pivot shaft 39.

An arm 89 secured to the boss 85 carries at its front end a fixed block 90, to which a supporting member 92 is turnably mounted via a shaft 91. In FIG. 11 again, a pin 93 mounted on the supporting member 92 turnably carries a pair of channel-shaped supporting pieces 94 and 95, to which core clamping pieces 96 and 97 are fixed. A compression spring 98 is provided inside of the supporting member 92 in order to urge the clamping pieces 96 and 97 against a stopper plate 99 so that said pieces have a prescribed distance between each other. The clamping pieces 96 and 97 are bent outwardly so that the cone can be received between them by forceably inserting the cone from the right upper side as viewed in FIG. 11. The function of the yarn guide plate 100 affixed to the lower side clamping piece 97 will be explained later.

An air cylinder 102 is carried by a block bracket 101 securely mounted on the arm 89, and its piston rod 103 is connected at the front end thereof to a projection 104 of the supporting member 92. This air cylinder 102 is of the single acting type, that is the piston rod 103 is always kept in its retreated position, by being urged by an internally installed spring, when the air is absent in the piston chamber. Due to the provision of an air cylinder of this type, the clamping pieces 96 and 97 are kept in the upwardly tilting disposition shown in FIG. 11 during their stand-by period.

In FIG. 12, a stop lever 105 is pivoted to a pin 107 on the fixed block 90. By the urging of a spring 106, one end face 105' of this stop lever 105 is placed into pressure contact with one end face 92' of the supporting member 92 in the disposition shown with chain-and-dot lines in FIG. 13 when the clamping pieces 96 and 97 assume the upwardly tilting disposition such as shown in FIG. 11.

Figure 13:
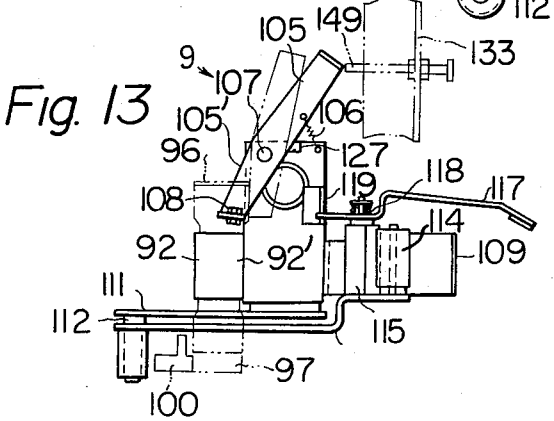
FIG. 13 is a view seen in the direction of the arrow D in FIG. 12.

When compressed air is admitted into the air cylinder 102 in FIG. 12, the supporting member 92 turns in order to put the clamping pieces 96 and 97 into the laterally directed disposition shown in FIGS. 12 and 13. The supporting member 92 also is positioned downwardly apart from the end face 105' of the stop lever 105 and the stop lever 105 is forced by the spring 106 to turn so as to stop at the position shown with solid lines in abutment against a stopper 127 on the fixed block 90. In this disposition, the stop lever 105 holds the clamping pieces 96 and 97 in a horizontal state while hindering upward displacement of the supporting member 92 beyond stopper 108 even when the compressed air is discharged from the air cylinder 102.

The fixed block 90 carries a core push-out auxiliary piece 109 in such a manner that the front end of the core assumes the position of this auxiliary piece 109 when the clamping pieces 96 and 97 assume the lateral disposition shown in FIG. 12 while clamping an empty core 110.

A supporting lever 111 is fixed to the lower surface of the fixed block 90 and a lever 113 is swingably pivoted on a pin 112 disposed to the front end of the supporting lever 111. The front end portion of this lever 113 rotatably carries a core pressing roller 114 and a bunch wind lever 117 is turnably mounted on a pin 116 of a block 115 fixedly located near the core pressing roller 114.

The bunch wind lever 117 is urged by a spring 118 into clockwise turning about the pin 116 in FIG. 12 so that the lever 117 swings downwardly. In the stand-by disposition, this lever 117 assumes the position shown in FIG. 12, with its engaging part 120 abutting a stopper 119 affixed to the block 90. The above-described lever 113 is connected to a fixed piece 121 to which is linked the front end of a piston rod 124 (see FIG. 11) of an air cylinder 123 mounted on a bracket 122.

Figure 14:
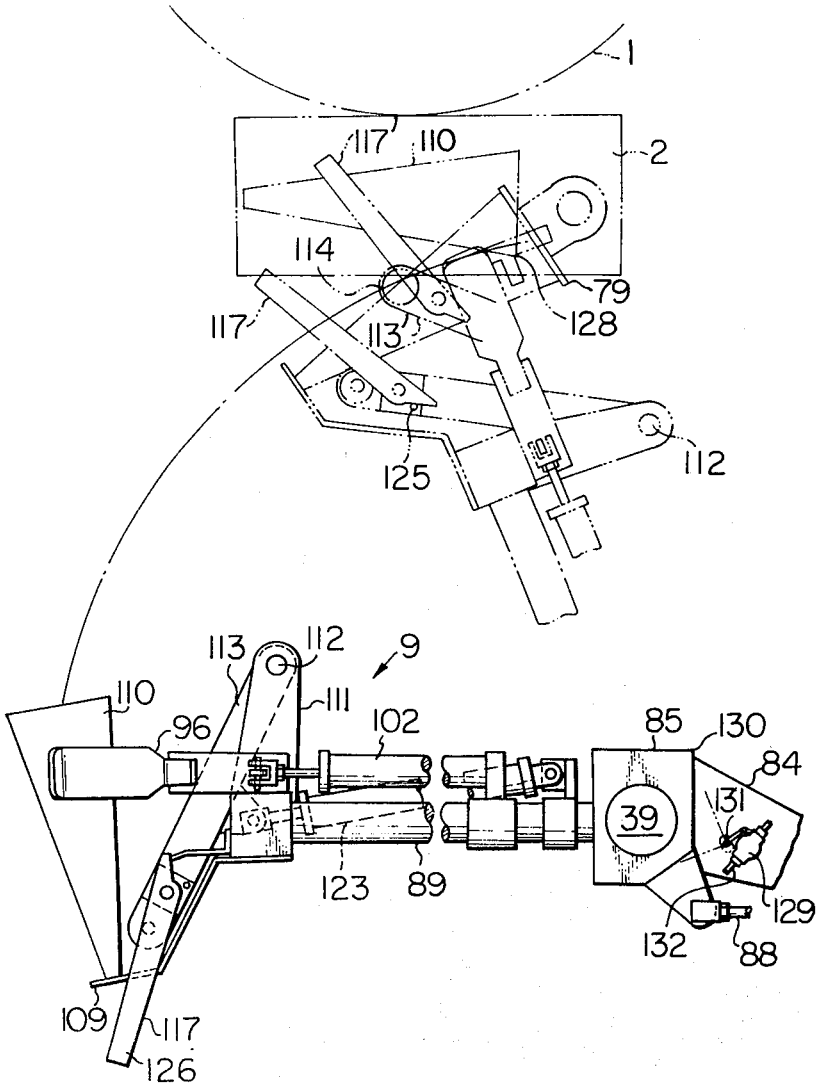
FIG. 14 is a top plan view of the core inserting mechanism in the operating condition.

When the empty core is clamped by the clamping pieces 96 and 97 by operation of a later described mechanism, and the pieces 96 and 97 are put into the lateral state by the forward stroke movement of the air cylinder 102, the air cylinder 87 turns the arm 89 about the pivot shaft 39 as shown in FIG. 14 and the auxiliary piece 109 pushes the empty core 110 over the core holder 79 of the winding unit 2. Next, the air cylinder 123 performs its forward stroke movement in order to turn the lever 113 about the pin 112 in FIG. 14 to the position shown by chain-and-dot lines 113'. The pressing roller 114 pushes the core so as to turn the core holder 79 to the regular core chucking position and, thereby, the core is fixed on the core holder 79.

On the other hand, during this turning of the lever 113, the bunch wind lever 117 is released from the stopper 119 as shown in FIG. 12 so as to turn to the position of abutment against a stopper 125 by means of the spring 118. The bunch wind lever assumes the disposition 117' shown in FIG. 14 while it lies over the core inserted over the core holder 79. Next, when the air cylinder 123 performs its return stroke movement and the lever 113 returns to its initial position, the bunch wind lever 117 moves, crossing over the empty core 110 with its front end 126 in pressure contact with the periphery of the core 110. The empty core 110 rotates together with the core holder 79 in the direction to wind up the yarn. At this moment, the yarn guide plate 100 (see FIG. 11) so functions as to correctly guide the yarn towards the core end, i.e. the guide cut-out 128 of the yarn guide plate 100 keeps the yarn connected to the bobbin 80 (see FIG. 5) on the core end.

As shown in FIGS. 11, 12 and 14, an air valve 129 is disposed on the supporting bracket 84, which valve is usually closed so as to cut off the air flow. When the core inserting mechanism 9 turns as shown in FIG. 14 for insertion of the empty core over the core holder, the corner 130 of the boss 85 pushes a roller 131 of the air valve 129 in order to open the same. By this opening of the valve, compressed air is admitted into the small air cylinder 81 (see FIG. 8A) via a pipe 132 and its piston rod 82 (see FIG. 8A) slightly turns the yarn guide plate 69 in order to free the yarn Y as shown in FIG. 10.

Figure 6:
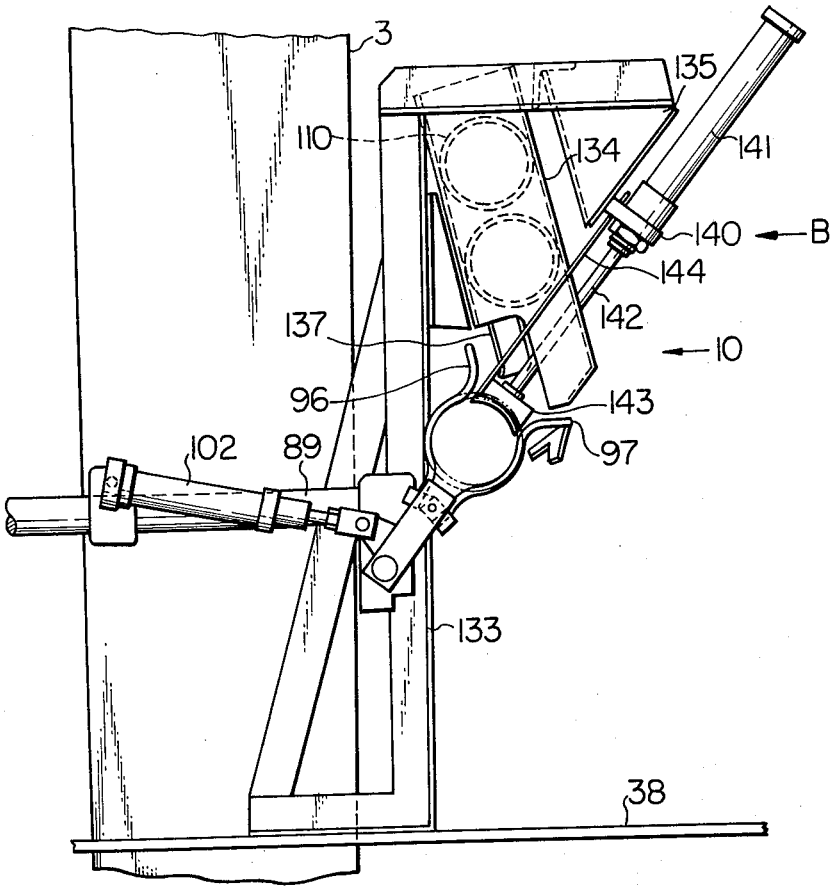
FIG. 6 is a front plan view of the core supply mechanism.
Figure 7:
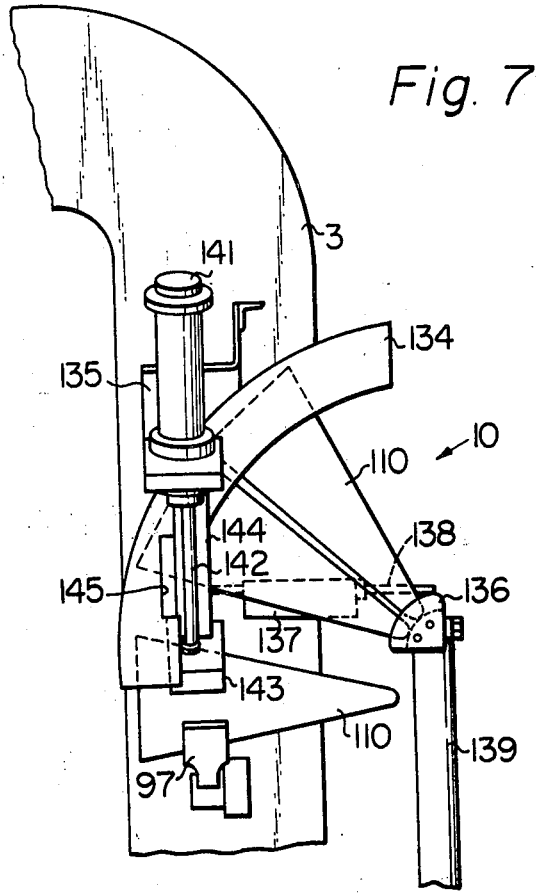
FIG. 7 is a view seen in the direction of the arrow B in FIG. 6.
Figure 9:
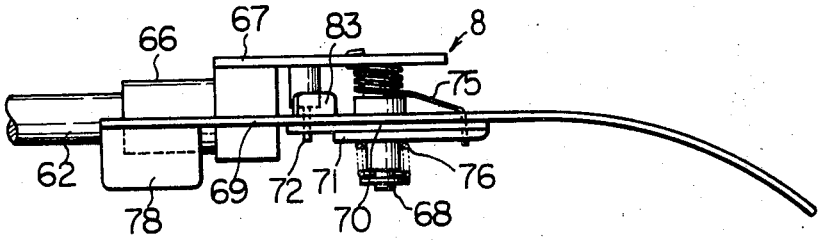
FIG. 9 is a view seen in the direction of the arrow C in FIG. 8.

FIGS. 6 and 7 show the arrangement of the core supplying mechanism 10 forming a part of the apparatus according to the present invention. In FIG. 6, an empty core magazine 134 and a bracket 135 are fixed to a stand 133 vertically mounted on the base plate 38. The empty core magazine 134 accommodates empty cores 110 in cooperation with a small magazine 136 (see FIG. 7), the preceding cores being stopped by a supporting piece 137.

In FIG. 7, the supporting piece 137 is urged by a spring (not shown) into turning about a shaft 138 towards the direction suited for holding the cores and then is kept stationary by a suitable stopper (not shown). The small magazine 136 is held by the blower box 150 in FIG. 1 via a supporting pole 139. Again in FIG. 6, a small block 140 affixed to the bracket 135 carries an air cylinder 141 whose piston rod 142 is provided with a push-out piece 143 at its front end. This push-out piece 143 carries a guide plate 144 which is inserted into the small block 140 so as to move together with the push-out piece 143.

Under the normal situation, the air cylinder 141 is in the retracted disposition and the nearest preceding core is held by the supporting piece 137. When it is time to supply a core, the piston rod 142 advances, the push-out piece 143 pushes down an empty core 110 from said supporting piece 137 passing through a cut-out 145 shown in FIG. 7, and the core is forcably inserted into the clamping pieces 96 and 97 which have been in the stand-by disposition, being tilted upwardly. During this process, the subsequent cores tending to fall down in the magazine are barred by the guide plate 144. In this way, the cores can be inserted one by one into the clamping pieces 96 and 97 without occurence of accidental wedging. When the piston rod 142 comes to the termination of its return stroke, the subsequent core falls down by its own weight until it is held by the supporting piece 137.

Figure 15:
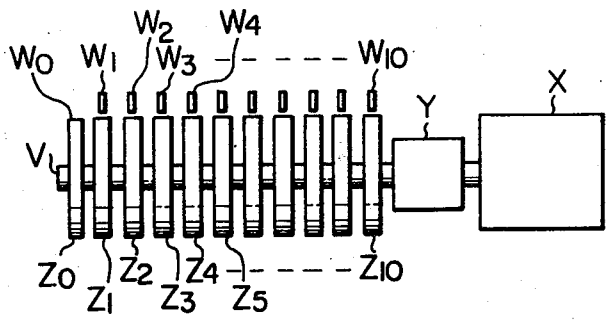
FIG. 15 is a top plan view of the programming cam arrangement.

A programming cam mechanism is shown in FIG. 15, in which 11 sets of cams $Z_0$ through $Z_{10}$ are fixedly mounted onto a shaft V which is driven via a known one-revolution clutch Y by a motor X. The cams $Z_0$ through $Z_{10}$ are accompanied by micro switches $W_0$ through $W_{10}$, respectively, so that on-and-off operation of the micro switches $W_1$ through $W_{10}$ causes switching of the air systems of the air cylinders 12, 30, 43, 55, 64, 81, 87, 102, 123 and 141. By this switching, the respective air cylinders operate in prescribed sequence. Switching-on of the micro switch $W_0$ restarts the winding operation. That is, one revolution of the shaft V produces a series of sequential operations from initiation of doffing to restarting of the winding operation.

Next, the sequentially combined operation of the entire system of the operation of the present invention will be explained. The winding units 2 circulate along the main body 1 of the winder and the winding unit 2 of a full package stops at one terminal of the main body 1 as shown in FIG. 1. Upon receipt of an instruction signal for initiation of the doffing operation, the air cylinder 12 of the position holding mechanism 4 starts its forward stroke motion and the package 25 is lifted slightly from the take-up drum 26 so as to be ready for the doffing action. Next, the piston rod 31 of the air cylinder 30 of the forwarding mechanism 5 advances and, thereby, the package 25 is forced to assume the disposition shown with the chain-and-dot lines in FIG. 2. In this situation, the package is set free from the hold of the core holder of the winding unit. On the other hand, an empty core 110 is inserted between the clamping pieces 96 and 97 of the core inserting mechanism 9 by the push-out piece 143 actuated by the air cylinder 141 of the core supplying mechanism 10. Next, due to the operation of the air cylinder 43 shown in FIG. 4, the package 25 is taken off from the core holder and falls down to the position of the stopper plate 52 along the receiver plate 50 of the package receiver mechanism 7, the yarn Y connecting the bobbin 80 of the winding unit to the package 25 assuming the path shown in FIG. 5.

Following this, the curved tube 61 of the yarn severing and holding mechanism 8 moves upwardly, being actuated by the air cylinder 64, in order to sever and hold the yarn Y in contact with the core holder 79 as shown in FIG. 10. In this situation, the air cylinder 87 in FIG. 12 so operates that the core inserting mechanism 9 is turned from the position for receipt of the empty core (shown with the solid lines) to the position for insertion of the empty core (shown with the chain-and-dot lines in FIG. 14,) the empty core is inserted over the bobbin holder and the yarn Y is clamped between the empty core and the core holder periphery.

At this moment, the air valve 129 is operated by the corner 130 of the boss 85, the valve is opened and the severing assembly of the yarn severing and holding mechanism 8 is opened and, thereby, the clamped yarn Y is set free. Next, the operation of the air cylinder 123 turns the lever 113, the core inserted over the core holder 79 is pushed by the core pressing roller 114, the core assumes the direction suited for the normal winding-up operation and the empty core is hence clamped by the bobbin holder.

The air cylinder 123 starts its return stroke motion in order to return the lever 113 to the original position and, concurrently with this, the core is rotated by the bunch wind lever 117 for the bunch winding.

During the above-described operations of the core inserting mechanism 9, the air cylinder 55 of the package receiver mechanism 7 comes into operation in order to turn the stopper plate 52 and, thereby, the package 25 provisionally held by the plate falls down into the reservoir box 59 in FIG. 1. At the same time, the air cylinder 64 starts its return stroke motion as shown in FIGS. 8 and 10 and the yarn severing and holding mechanism 8 returns to its original position.

After completion of the bunch winding operation, the core inserting mechanism 9 returns to its original position by operation of the air cylinder 87 (see FIG. 12), the stop lever 105 comes into abutment with the stopper 149 fixed to the stand 133 as shown in FIG. 13. The stop lever 105 turns in the counterclockwise direction about the pin 107 overcoming the repulsion by the spring 106 and the stopper 108 is disengaged from the supporting member 92. As shown in FIG. 11, the supporting member 92 is actuated for movement by the air cylinder 102 (return stroke) until it assumes the upwardly tilting disposition shown in FIG. 11. Next, the air cylinder 12 in FIG. 2 starts it return stroke motion in order to lower the cradle and make the empty core held by the core holder 79 (see FIG. 5) contact the take-up drum 26. The air cylinder 12 further lowers until it stops with the clamper pawls 19 and 20 being disengaged from the pin 24 of the increase lever as shown in FIG. 3. Under this situation, the winding operation is restarted and the winding unit again travels along the main body 1 of the winder.

The following advantages result from employment of the present invention.

1. Successful doffing could be achieved regardless of the size and type of yarn packages, e.g. cheese-type packages or cone-type packages. This is because of the fact that once the full package is lifted from the drum surface, the core holder is maintained at a prescribed level and the end of the package is pushed in its axial direction until the package falls down onto the package receiver mechanism.

2. Smooth insertion of the core is assured by the fact that the clamping pieces 96 and 97 of the insertion mechanism are turned by a single acting air cylinder and, due to this actuation system, the pieces swing following the core holder while resisting the spring force in the cylinder at the time of the core insertion over the core holder.

3. Normal bunch winding is assured even without provision of a special mechanism for rotating the core for the purpose of the bunch winding by the fact that the bunch wind lever 117 turns so as not to touch the core when the core pressing roller 114 advances. The bunch wind lever recedes without turning when the core pressing roller returns and, due to the urging of the spring 118, the front bent portion of the bunch wind lever 117 comes into pressure contact with the core only at this stage of the sequential operations. Thereby, undesirable reverse rotation of the core at advancement of the roller is effectively prevented.

What is claimed is:

1. An apparatus for doffing and inserting empty cores on automatic winder having core holders each adapted to clamp and free a core by assuming first and second prescribed positions respectively, and each mounted to urge a core mounted thereon toward a winding drum for forming full packages of yarn on the core from yarn on a bobbin, during a winding operation, said apparatus comprising, in combination, a position holding mechanism for lifting a full package from a winding drum, a forwarding mechanism for turning a core holder from a first position to a second position comprising means positionable to engage and push a side of a full package lifted by said position holding mechanism, a package take-off mechanism for taking off said full package comprising means positionable to engage and push one end of a full package on a core holder turned to its second position by said forwarding mechanism, a receiver mechanism positioned to receive a full package taken off a core holder by said take-off mechanism, a yarn severing and holding mechanism positionable to sever a yarn portion extending from a full package in said receiver mechanism to a bobbin and to hold the end of the severed yarn extending to said bobbin, and a core inserting mechanism comprising means positionable to insert an empty core over a core holder from which a full package has been taken off by said take-off mechanism and means positionable to engage and push a side of said empty core on said core holder for returning said core holder to its first position.

2. The apparatus of claim 1 wherein said receiver mechanism comprises chute means positioned to receive full packages taken off a core holder by said take-off mechanism, and means for releasably holding full packages in said chute means, whereby full yarn packages may be retained in said chute means during severing of a yarn by said yarn severing and holding mechanism.

3. The apparatus of claim 1 in which said first and second positions are angularly displaced positions about a vertical axis, said position holding mechanism comprising means for vertically lifting a core holder and a full package held thereby to an elevated position, and for holding the respective lifted core holder at said elevated position until an empty core has been placed thereon and said means positionable to engage and push a side of said empty core has acted to return said core holder to its first position.

4. The apparatus of claim 3 wherein said means positionable to engage and push a side of a full package lifted by said position holding mechanism comprises means positionable to engage a side of said full package to angularly displace said full package from said first position to said second position.

5. The apparatus of claim 1 wherein said core inserting mechanism comprises a supporting member, a pair of clamping members supported on said supporting member and adapted to clamp an empty core therebetween, single acting air cylinder means positioned to rotate said supporting member for thereby rotating said clamping members about a first axis between a position for receiving an empty core and a position aligned horizontally with said core holder, and releasable stopping means positioned to hold said clamping members to inhibit their return to said empty core receiving position.

6. The apparatus of claim 5 further comprising a holding assembly, said supporting member being pivotally mounted to said holding assembly for rotation about said first axis, and means for rotating said holding assembly about a second axis normal to said first axis for moving said clamping members to insert an empty core held thereby onto a core holder in said second position.

7. The apparatus of claim 5 wherein said core inserting mechanism further comprises means responsive to insertion of an empty core over a core holder at said second position for pushing said empty core from said clamping pieces, and lever means engageable with an empty core on a core holder in said first position for rotating said core holder.

8. The apparatus of claim 1 wherein said means positionable to engage and push a side of said empty core on said holder comprises a lever rotatably mounted to said means positionable to insert an empty core over said core holder, and a core pressing roller rotatably mounted on said lever and positioned to engage and push a side of said empty core on said core holder.

9. The apparatus of claim 8 further comprising a bent lever means pivotally mounted to said lever, stop means on said means positionable to insert an empty core over a core holder, and spring means mounted to urge said bent lever means into engagement with said stop means, whereby said bent lever means rotates with respect to said lever upon movement of said lever to effect engagement of said core pressing roller with an empty core on a core holder, said means positionable to insert an empty core over a core holder being movable between a position for receiving an empty core and a position for inserting an empty core received thereby on a core holder at said second position, said bent lever means having an end positioned to be engageable with a core on a core holder at said first position for effecting the rotation of said last-mentioned core holder upon return of said means positionable to insert an empty core toward said core receiving position.

* * * * *

UNITED STATES PATENT OFFICE

CERTIFICATE OF CORRECTION

Patent No. 3,971,520 Dated July 27, 1976

Inventor(s) Junichiro Shimai

It is certified that error appears in the above-identified patent and that said Letters Patent are hereby corrected as shown below:

In the Abstract of the Disclosure, line 2 from the bottom: after "e.g." insert a comma.

Column 1, line 8: Delete "the" (second occurrence).

Column 2, line 68: Delete "inserted".

Column 5, line 28: Change "inserted over" to --mounted on--.

line 29: Change "mounted on" to --inserted over--.

line 58: Change "retreated" to --retracted--.

Column 6, line 66: Before "rotates" insert --thereby--.

Column 8, line 37: "Fig. 14,)" should be --Fig. 14),--.

Column 9, line 27: Change "insertion" to --inserting--.

Signed and Sealed this

Fourth Day of January 1977

[SEAL]

*Attest:*

RUTH C. MASON
*Attesting Officer*

C. MARSHALL DANN
*Commissioner of Patents and Trademarks*